US007866332B1

(12) United States Patent
Mizrahi

(10) Patent No.: US 7,866,332 B1
(45) Date of Patent: Jan. 11, 2011

(54) APPARATUS FOR SHIELDING AN ELEVATED FIXTURE

(76) Inventor: Eliahu Mizrahi, 10 Canterbury Dr., Freehold, NJ (US) 07728

( * ) Notice: Subject to any disclaimer, the term of this patent is extended or adjusted under 35 U.S.C. 154(b) by 8 days.

(21) Appl. No.: 12/437,164

(22) Filed: May 7, 2009

Related U.S. Application Data

(60) Provisional application No. 61/051,046, filed on May 7, 2008.

(51) Int. Cl.
*E04H 15/02* (2006.01)

(52) U.S. Cl. ..... 135/88.01; 135/90; 135/96; 135/912; 52/63; 134/200

(58) Field of Classification Search ..... 135/88.01, 135/88.05, 88.1, 88.13, 88.17, 90, 96, 905, 135/903, 912; 52/79.5, 143, 63; 134/19, 134/200; 312/1
See application file for complete search history.

(56) References Cited

U.S. PATENT DOCUMENTS

D206,386 S * 12/1966 Vermette ..... D34/31
3,358,789 A * 12/1967 Laun ..... 182/113
4,682,448 A * 7/1987 Healey ..... 52/63
4,911,191 A * 3/1990 Bain ..... 134/200
5,002,082 A * 3/1991 Roder ..... 135/88.01
5,024,246 A * 6/1991 Bain ..... 134/200
5,062,871 A * 11/1991 Lemon, III ..... 55/385.2
5,088,511 A * 2/1992 Bain ..... 134/200
5,195,726 A * 3/1993 Kaner ..... 254/325
5,340,218 A * 8/1994 Cuthbertson ..... 383/67
5,430,980 A * 7/1995 Ferrier ..... 52/63
5,797,411 A * 8/1998 Parker ..... 135/136
6,390,450 B1 * 5/2002 Bressner et al. ..... 254/4 B
6,694,538 B1 * 2/2004 Jones ..... 4/476
7,188,636 B1 * 3/2007 Kanne et al. ..... 135/142
7,406,978 B2 * 8/2008 Mintie et al. ..... 135/131
2009/0133721 A1 5/2009 Campbell

* cited by examiner

*Primary Examiner*—Winnie Yip
(74) *Attorney, Agent, or Firm*—Wall & Tong, LLP

(57) ABSTRACT

An apparatus for shielding an elevated fixture, such as a chandelier, ceiling fan or other elevated fixture to create a work volume proximate the fixture adapted to contain, illustratively, fixture cleaning materials.

17 Claims, 6 Drawing Sheets

APPARATUS FOR SHIELDING AN ELEVATED FIXTURE

CROSS REFERENCE TO RELATED APPLICATIONS

This application claims the benefit of U.S. provisional patent application Ser. No. 61/051,046, filed on May 7, 2008, entitled APPARATUS FOR CLEANING CHANDELIERS, which application is incorporated herein by reference in its entirety.

FIELD OF THE INVENTION

This invention relates to apparatus for shielding an elevated fixture such as a chandelier, ceiling fan or other elevated fixture to create a work volume proximate the fixture adapted to contain, illustratively, fixture cleaning materials.

BACKGROUND

Once a fixture such as a fan or chandelier is installed in an elevated position (e.g., a ceiling), homeowners face the problem of cleaning the fixture. Some homeowners never try to clean the fixture, while others try piecemeal cleaning approaches such as removing chandelier crystals to hand wash and so on. Many homeowners cannot reach the fixture, such as with a chandelier installed in a foyer 20 with a high ceiling. Even chandeliers attached to lower ceilings still require cleaning, such as those found in a dining room or other room. Many homeowners are reluctant to spray cleaning solutions since they do not want to damage the fixture, walls, artwork or furniture that may be near the fixture.

BRIEF SUMMARY

Various deficiencies of the prior art are addressed by the present invention of an apparatus for shielding an elevated fixture, such as a chandelier, ceiling fan or other elevated fixture to create a work volume proximate the fixture adapted to contain, illustratively, fixture cleaning materials.

In one embodiment, an apparatus for shielding an elevated fixture comprises a portable assembly comprising a base portion; a vertical member coupled to the base portion; and a curtain support portion coupled to the vertical member, the elevation of the curtain support portion relative to the base portion being adjustable via the vertical member; the portable assembly being configurable between a collapsed position and an operational position, the collapsed position having size adapted to fit through a standard door opening; and a curtain sized to be suspended from the curtain support portion when the curtain support portion is in the operational position, the curtain having at least one side and a bottom, a top of the side adapted for coupling to the curtain support portion, the bottom having a drain port.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION OF THE INVENTION

The invention will be primarily described within the context of an apparatus that enables the cleaning of fixtures such chandeliers, fans and the like. However, those skilled in the art and informed by the teachings herein will realize that the invention is also applicable to the formation of elevated workspaces for the cleaning or servicing of any elevated fixture where protection of items near the fixture is important.

Advantageously, the apparatus can reach chandeliers that hang over stairways, over tables that are too heavy to move, high ceilings without a lift to lower, and in other hard to reach places. The apparatus has the ability to move around obstacles in a room and, in one embodiment, to reach heights of approximately 20 feet. A curtain hangs from extended arms on the apparatus to wrap partially around the chandelier, forming thereby a workspace that protects the nearby surroundings from cleaning spray damage.

Advantageously, the apparatus also allows for cleaning without touching the chandelier, thereby eliminating the risk of damaging crystals or other hanging parts.

The various embodiments discussed herein are primarily discussed within the context of steel, aluminum or other metal frame components having a rectangular, triangular, round, oval or (generally) rectilinear cross sections. A frame component having an outer cross sectional dimension smaller than the inner cross sectional dimension of another frame component is able to slide into the other frame component. In some instances, extension components are described as be coupled with hinges or other folding means. In these instances, the inventor contemplates that the extension components may also be slidably engaged in the same manner as other frame components.

Figure 1:
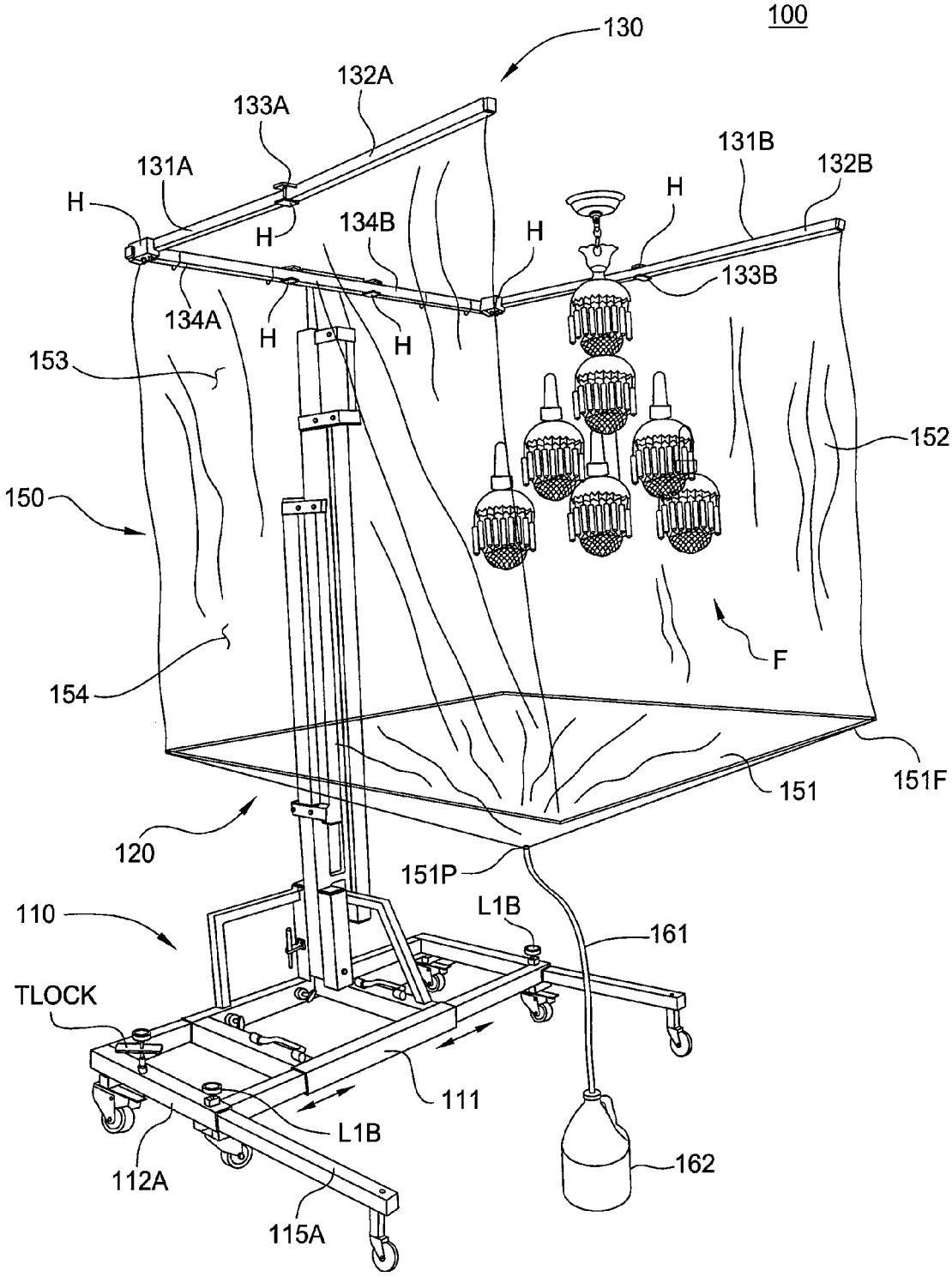
FIG. 1 depicts a perspective view of one embodiment of a shielding apparatus.
Figure 2:
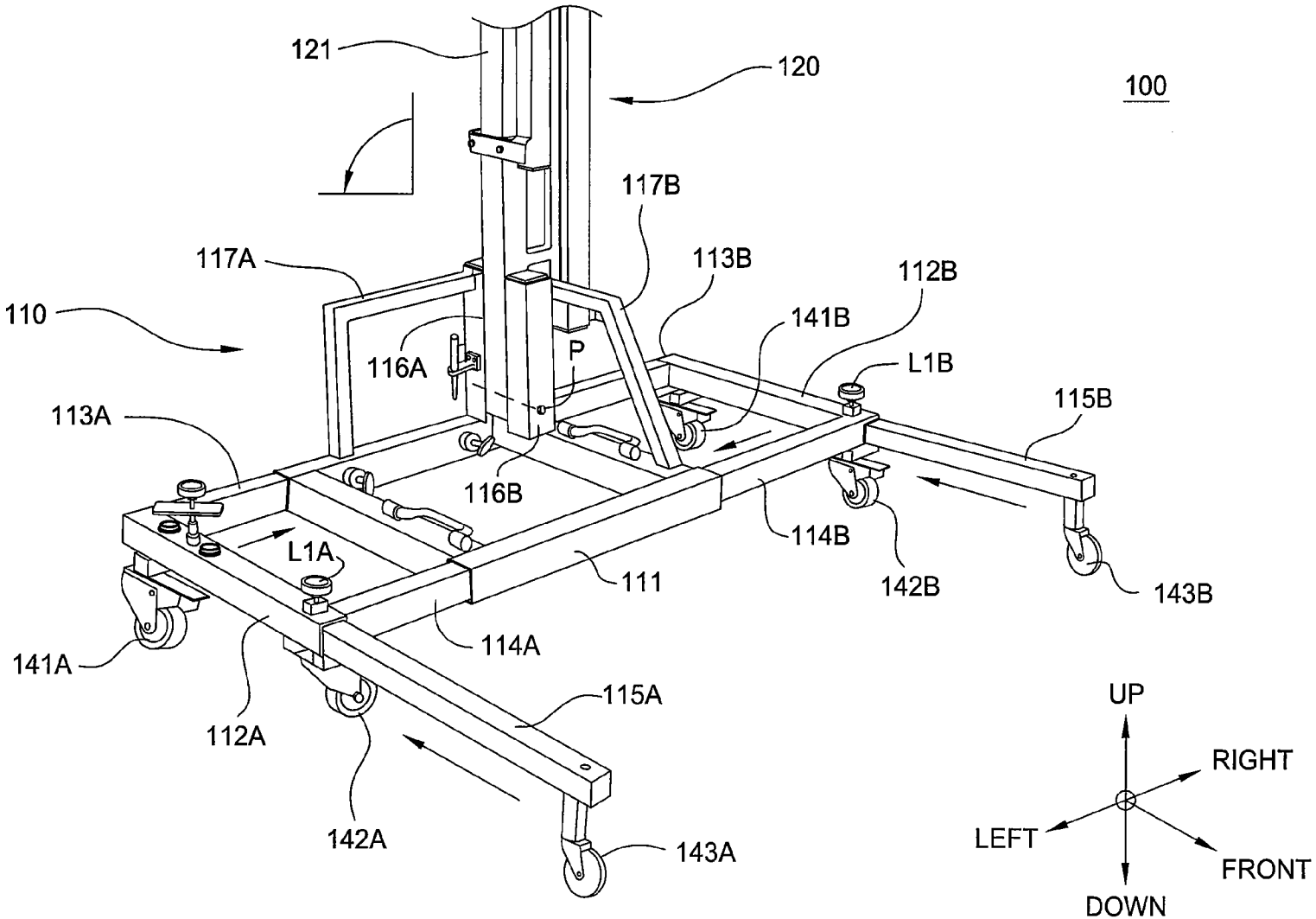
FIG. 2 depicts a perspective view of a base portion of the embodiment of FIG. 1.
Figure 3:
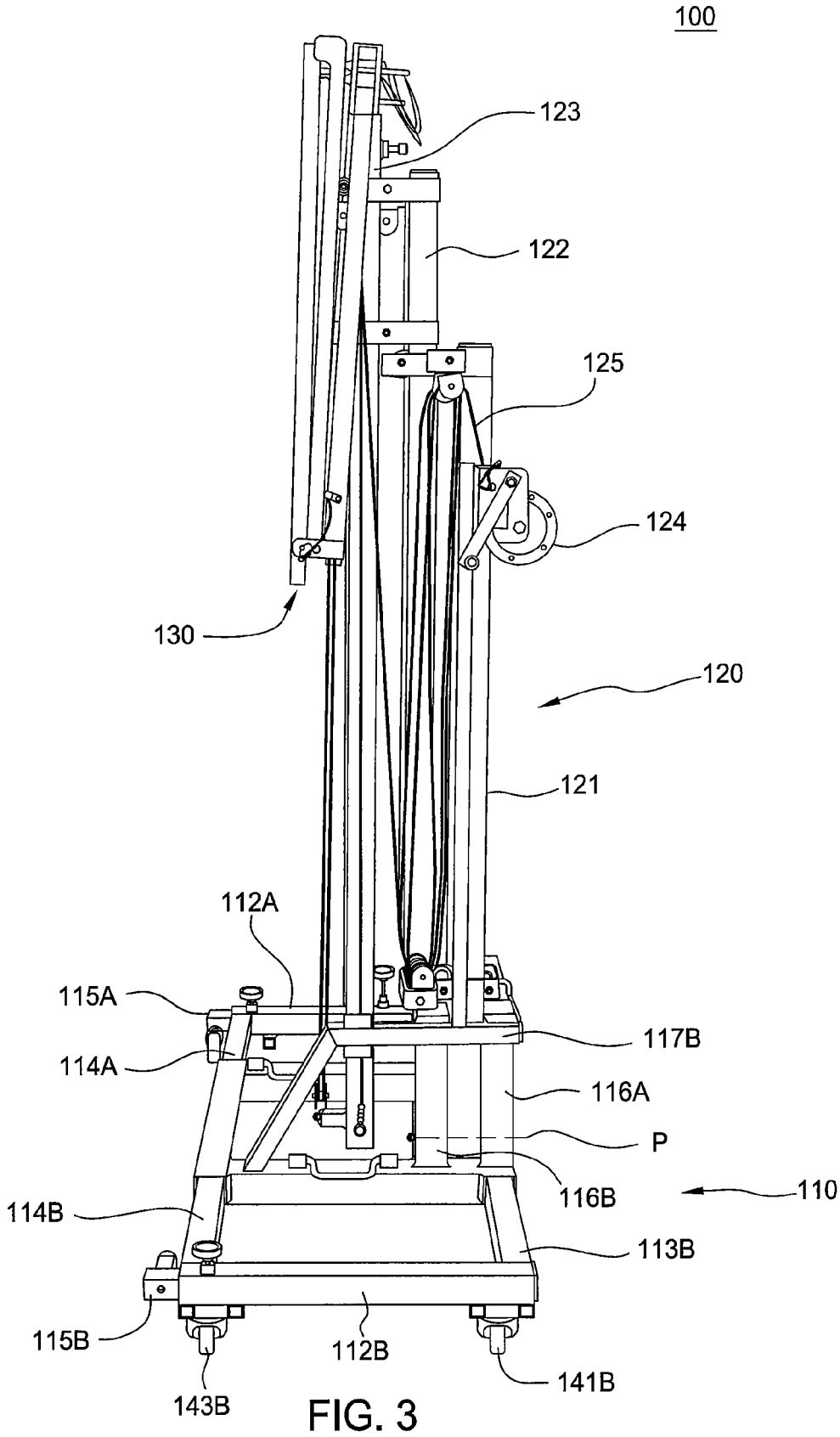
FIG. 3 depicts a side view of the embodiment of FIG. 1 in an erect or extended mode of operation.
Figure 4:
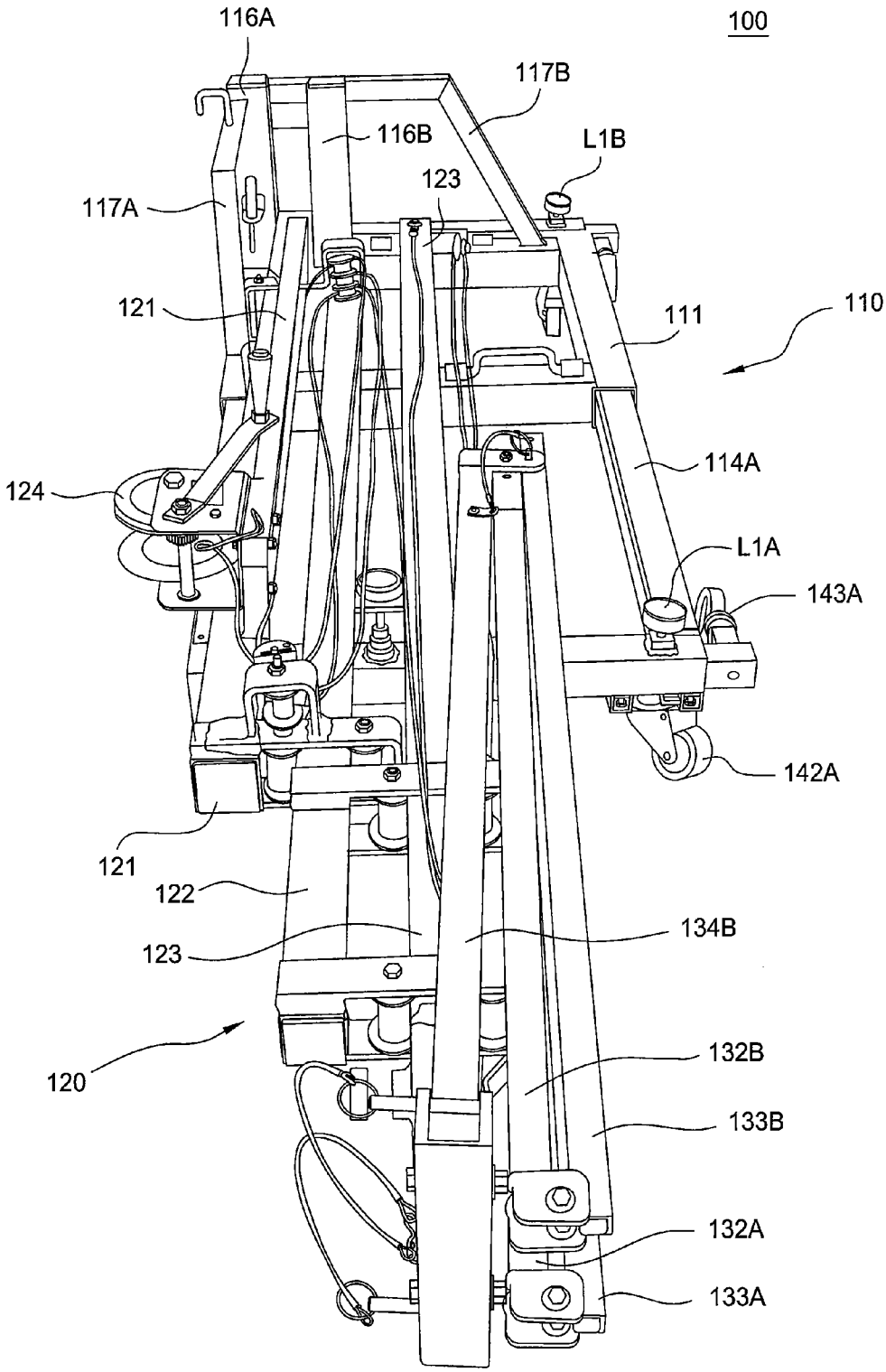
FIG. 4 depicts a side view of the embodiment of FIG. 1 in a folded or retracted mode of operation.
Figure 5:
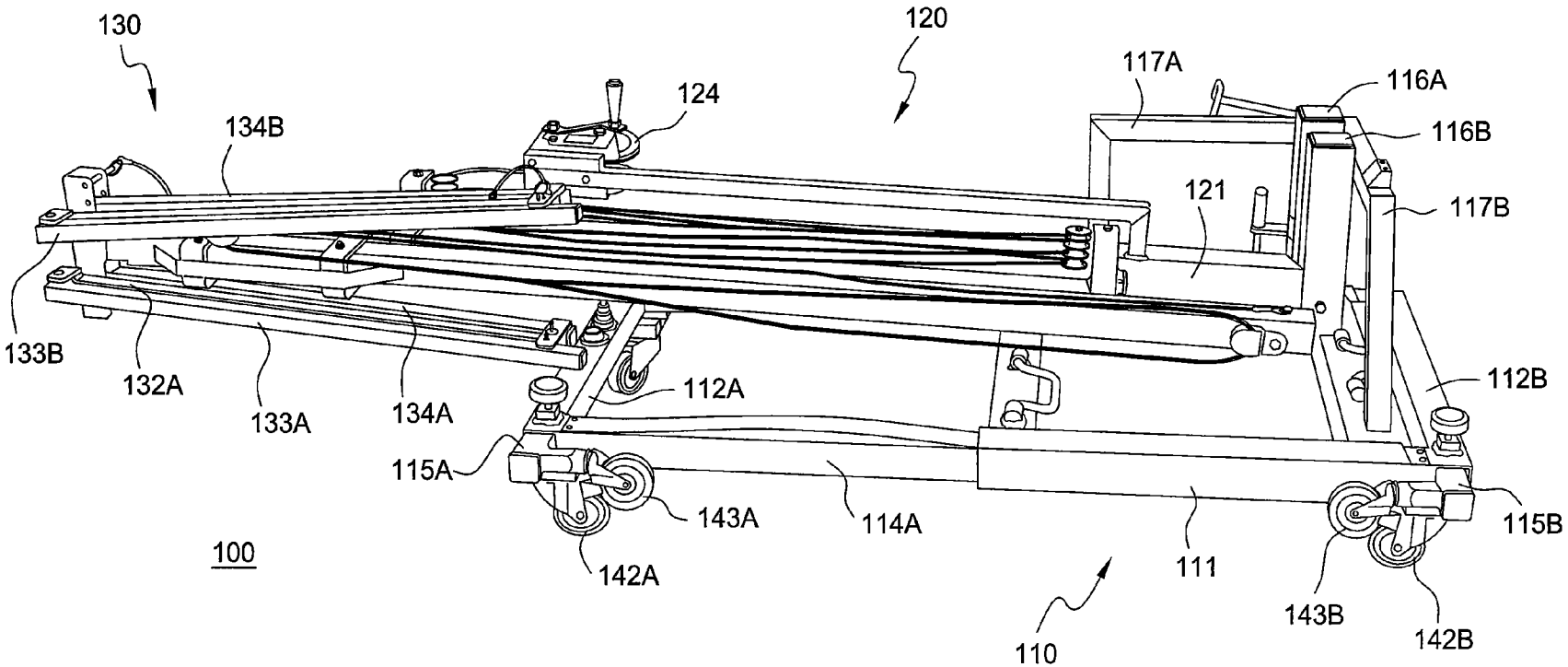
FIG. 5 depicts a front view of the embodiment of FIG. 1 in a folded or retracted mode of operation.
Figure 6:
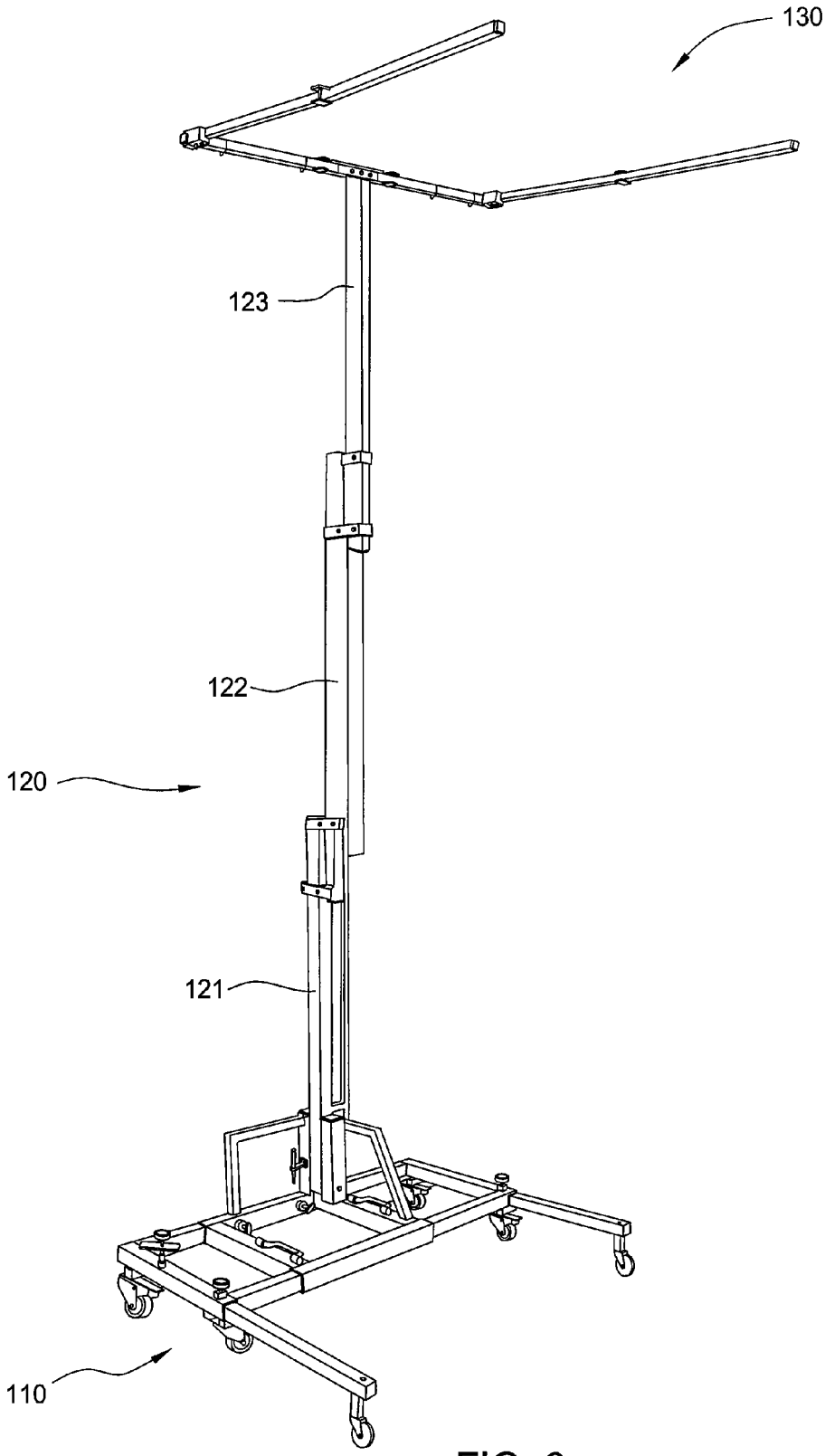
FIG. 6 depicts a perspective view of the embodiment of FIG. 1 in an unfolded or extended mode of operation.

FIG. 1 depicts a perspective view of one embodiment of a shielding apparatus; FIG. 2 depicts a perspective view of a base portion of the embodiment of FIG. 1; FIG. 3 depicts a side view of the embodiment of FIG. 1 in an erect or extended mode of operation; FIG. 4 depicts a side view of the embodiment of FIG. 1 and a folded or retracted mode of operation; FIG. 5 depicts a front view of the embodiment of FIG. 1 in a folded or retracted mode of operation; and FIG. 6 depicts a perspective view of the embodiment of FIG. 1 in an unfolded or extended mode of operation. The various portions in some portions the shielding apparatus 100 will be discussed in conjunction with all of the figures, which figures share common reference numerals.

Specifically, for shielding apparatus 100 of FIG. 1 generally comprises a base portion 110, a vertical member 120 and a curtain support portion 130. The base portion 110 cooperates with a set of wheels 140 provide mobility to the apparatus. The curtain support portion 130 supports a curtain 150 which is shaped to define thereby a workspace or work volume within which a fixture F is to be cleaned or otherwise processed. The curtain 150 includes bottom portion shaped to include a lower region with a drain port to drain cleaning fluid previously imparted to a fixture to be cleaned.

The base portion 110 comprises a main base member 111 upon which first 116A and second 116B posts are perpendicularly disposed. The main base member 111 comprises, illustratively, an aluminum frame having a substantially rectilinear shape that is capable of insertably or slidably receiving other frame components so that the base portion 110 may be effectively increased in size and, therefore, stability as a platform for the vertical member 120.

First post 116A is further supported by the first brace 117A, which extends 20 from an upper left portion of first post 116A toward a left portion of main base member 111. The first 116A and second 116B posts are further supported by second brace of 117B, which extends between an upper right portion of each of the posts toward a front portion of main base member 111.

A lower portion of the vertical member 120 is disposed between the posts 116 and pivotally engaged with a pivot point or pin inserted through the lower portions of the posts 116 and a lower portion of the vertical member 120. In one embodiment, the vertical member 120 pivots from a leftward (retracted) position to a vertical (extended) position where the portion of the second brace 117B extending between the posts 116 operates as a stop to the further pivoting of the vertical member 120.

The base portion 110 optionally include one or both of a left lateral extension portion and a right lateral extension portion adapted to provide further lateral support of the main base member 111. Each of the left and right lateral extension portions optionally includes a secondary extension portion, illustratively a forward projecting secondary extension portion.

The optional left lateral extension portion comprises a U-shaped structure adapted to be slidably engaged with the left side of main base member 111. The left lateral extension portion comprises rear extender 113A, front extender 114A and crosspiece 112A. The front and rear extenders are slidably engaged with the left side of the main base member 111 to extend or retract crosspiece 112A.

An optional secondary extension portion 115A of the left lateral extension portion is slidably engaged with crosspiece 112A to extend forward (as depicted in the figures) or backward (not shown) to provide thereby further support of the main base member 111.

The optional right lateral extension portion comprises a U-shaped structure adapted to be slidably engaged with the right side of main base member 111. The right lateral extension portion comprises rear extender 113B, front extender 114B and crosspiece 112B. The front and rear extenders are slidably engaged with the right side of the main base member 111 to extend or retract crosspiece 112B.

An optional secondary extension portion 115B of the right lateral extension portion is slidably engaged with crosspiece 112B to extend forward (as depicted in the figures) or backward (not shown) to provide thereby further support of the main base member 111.

When extended, crosspiece 112A is optionally locked into place via locking pin L1A, which extends through crosspiece 112A and left rear extender 113A. Similarly, when extended, crosspiece 112B is optionally locked into place via locking pin L1B, which extends through crosspiece 112B and right rear extender 113B. Generally speaking, each of the extendable, slidably engaged, hinged or otherwise articulating members or portions of the embodiment described herein are optionally locked into an operations configuration using locking pins, ratchet mechanisms or other suitable securing means. Similarly, when in a folded or nonoperational configuration, suitable support mechanisms may be provided to ensure that metal portions are protected such that cosmetic or structural damage is avoided during transport and/or operation of the apparatus.

In one embodiment, the left and right lateral extension portions are formed as a single frame along which the main base member 111 is slidably engaged. That is, a four member (rectilinear) frame is formed using: (1) crosspiece 112A; (2) crosspiece 112B; (3) combination of rear extenders 113A and 113B; and (4) combination of front extenders 114A and 114B. The rear portion of this frame (113A/113B) slides within the rear portion of main base member 111, while the front portion of this frame (114A/114B) slides within the front portion of main base member 111. In this manner, the entire work area or chamber formed by the curtain may be moved laterally to enable improved access to fixtures. Thus, the base portion is formed as a first frame portion slidably engaged with a second frame portion to provide thereby lateral position adjustment of the vertical member.

In one embodiment, a locking mechanism TLOCK is provided to secure the vertical member 120 to the base 110 in a folded or retracted position, such as for transporting the apparatus. Locking mechanism TLOCK is depicted as being connected to left crosspiece 112A, though any location suitable for restraining the vertical member may be used.

In one embodiment, a set of wheels supports the left and right lateral extension portions of the base portion 110. Specifically, in this embodiment, crosspiece 112A is supported by rear 141A and front 142A wheel assemblies, while crosspiece 112B is supported by rear 141B and front 142B wheel assemblies. Further in this embodiment, the outermost portion of the secondary extensions (with respect to the lateral extension portions from which they emanate) is also supported by a wheel assembly 143.

The vertical member 120 comprises, illustratively, three vertical member portions that cooperate to selectively define an overall length of the vertical member 120. Specifically, lower vertical member portions 121 is pivotally engaged between the posts 116 as discussed above with respect to the base 110. Middle vertical member portion 122 is coupled to lower vertical member portion 121, while upper vertical member portion 123 is coupled to middle vertical member portion 122. In general, the vertical member portions are coupled to each other via a mechanism adapted to control their respective extension. Specifically, referring to FIG. 3, each of the vertical member portions is coupled to one or more pulleys having wires or rope running there between to a crank 124. The crank 124, when rotated in the appropriate direction, operates to wind the wire or rope such that the pulleys of the vertical member portions are brought closer together, thereby extending the length of the vertical member 120.

Optionally, the respective extension of the vertical member portions is controlled by any of a linear actuator, electric motor actuator, set screw, hydraulic actuator and/or pneumatic actuator.

The curtain support portion 130 is coupled to the top of the vertical member 120 (e.g., the top of upper vertical member portion 123). The curtain support portion 130 supports a curtain 150 which is shaped to define thereby a workspace or work volume within which a fixture is to be cleaned or otherwise processed. In various embodiments the curtain support portion 130 by workspace which (when viewed from above) is U-shaped, V-shaped, semi-circular in shape and so on. Anybody may depict in the various figures, the top view of the workspace is U-shaped. In general, the curtain support portion 130 is adapted to support a curtain 150 shaped to protect surrounding walls, furniture and the like from cleaning fluids or other processing materials used on the elevated fixture.

Within the context of the figures, the U-shaped curtain support portion is formed by a rear support member 134 attached to the top of the vertical member 120. The rear support member 134 comprises left 134A and right 134B portions hinged from a center/rear support structure that is mated to the top of the vertical member 120. The rear support member 134 is depicted in a left-right orientation in the various figures. Rear support member 134 is coupled (e.g., via a hinge) to each of a left 131A and right 131B perpendicular extension member to form there by a U-shaped curtain support portion 130.

Optionally, the left 131A and right 131B perpendicular extension members may be further extended by, respectively, left 132A and right 132B support extension members.

Optionally, rear support member 134 is rotatably attached to the top of the vertical member 120 such that the access point to the workspace formed by the curtain (i.e., the aperture in the curtain) may be rotated to enable cleaning of the fixture from any useful angle. The optional rotation of the workspace or chamber, especially when coupled with the optional lateral shifting of the vertical member (see discussion of frame in frame slidable engagement with respect to base portion 111) provides great flexibility in positioning the chamber as needed where obstacles may exist in a room including a fixture to be cleaned or otherwise processed.

In operation, curtain 150 hangs from the curtain support portion 132 form thereby the workspace/work volume within which a fixture to be processed or cleaned is located (i.e., by appropriately positioning the base portion 110 of the apparatus 100). In this manner, the curtain provides protection to the nearby surroundings from cleaning spray damage from cleaning fluids and/or other processing materials used to process a fixture.

In a U-shaped embodiment, the curtain 150 includes, illustratively, bottom 151, right 152, back 153 and left 154 curtain portions. The bottom portion 151 of the curtain 150 is additionally shaped to include a lower region with a drain port 151P used to drain cleaning fluid and other debris via, illustratively, a hose 161 coupled to a liquid storage container 162. Optionally, a frame 151-F is disposed about the bottom portion 151 of the curtain to provide mechanical rigidity where cleaning solutions, process materials and so on might operated to weigh down the bottom portion 151 such that the side portions 152, 153 and 154 might collapse inward.

The shielding apparatus as depicted in FIG. 1 illustrates an embodiment wherein the vertical member 120 is in an operational or erect position, while the shielding apparatus as depicted in FIG. 4 illustrates an embodiment wherein the vertical member 120 is in a nonoperational or collapsed position (e.g., such as for transport). The shielding apparatus as depicted in FIG. 1 further illustrates an embodiment including deployed left and right lateral extension portions including respective front perpendicular extension members.

Within the context of transporting the shielding apparatus, the shielding apparatus folds/collapses into a size adapted to fit through a common door opening such as in a house. Standard single door sizes are typically 2.5 to 4 feet wide by 8 to 10 feet high. These and other sizes are used in single door, double door and sliding door configurations.

In one embodiment, the base of the device is made from an aluminum frame where the dimension of the base is L=52"× W=24". The lateral sliding frame portions add more mobility to get around obstacles in the room. On the bottom of the base, there are 4 swivel casters, of which 2 include a brake device, plus 2 extension arms for stability and mobility (also with swivel casters). A system of twin rollers sit between the vertical member portions (columns) and sets of pulleys, with steel cables and a manually geared roller to operate the system.

The vertical member portion or system connects to the main base with a pin and is built with 3 main columns and a locked handle, where the cables have been stretched between them.

The device folds to a minimum of 20 inches. The length is 7 feet and the width is 24 inches. This allows for easy transport and less storage space and one person lifting capability. The height and width of the device allows for entry into home and into all rooms, doors, hallways, etc. It allows for easy maneuvering around furniture, heavy tables and also above tables.

Connected to the device are, optionally, two types of extensions which include: small and large arms (6 ft×6 ft and 4½ ft×4½ ft) which are locked by removable safety pins. The extended arms can be added to the device either while in the folded (nonoperational) position or upright (operational) position, and can be placed pointing in any of several directions, such as three different directions (front and two sides).

Operation of device is straightforward, the apparatus is brought into a house with a fixture to be cleaned, positioned under the fixture, opened up, extended to reach the fixture (as necessary) and locked in place. The large extension gives the ability to extend the height by 6 ft, if needed. The extension is raised and lowered by a portable handle, which is maneuvered inside the lead column groove.

On top of the open stretched arms, a clear vinyl chamber (i.e., a work volume or area) encases the open stretched arm extensions (6 ft×6 ft) for large arm extension and (4½ ft×4½ ft) for small arm extension. On the bottom of the chamber, on all 4 sides are narrow sleeves, which allow the aluminum stretchers to be placed. Two rods are placed on sides of chamber. Two hollow tubes are placed in front and back. They connect together on all four corners and give the chamber a square shape, while also allowing for stretching. In the middle of the bottom chamber, there is a drain port, which connects to a hose.

When opening this embodiment of the device, from a folding to upright position, with arm extension already in place, a minimum height of this embodiment is about 7 feet, and a maximum height of this embodiment is about 20 feet. Different minimum and maximum heights may be optionally provided.

After device has been in place to do job and the chamber has been stretched to right size, the top/side only is open. The process of lifting to required height is with the help of a pulley system, the chandelier is surrounded by, illustratively, three sides and a bottom.

The final adjustment of the chamber is to move the secondary frame left or right or swivel device 360 degrees, which depends on the condition of the room and existing obstacles in the room.

Optionally, more or fewer than two operational arms are used, such as where there are difficulties encountered in achieving the proper shielding position for a particular fixture.

Various curtain materials may be used, such as plastic, vinyl, cloth and so on. The selection of curtain material is made in view of the fixture to be processed, the type of processing and so on. In various embodiments the curtain material is clear so that a light may be directed through the curtain at the fixture to be cleaned or otherwise processed.

While the foregoing is directed to various embodiments of the present invention, other and further embodiments of the invention may be devised without departing from the basic scope thereof. As such, the appropriate scope of the invention is to be determined according to the claims, which follow.

What is claimed is:

1. Apparatus for shielding an elevated fixture to enable cleaning of the elevated fixture, the apparatus comprising:

a portable assembly comprising:

a base portion;

a vertical member coupled to the base portion; and a curtain support portion coupled to the vertical member, an elevation of the curtain support portion relative to the base portion being adjustable via the vertical member;

the portable assembly being configurable between a collapsed position and an operational position, the collapsed position having a size adapted to fit through a standard door opening; and a curtain sized to be suspended from the curtain support portion when the curtain support portion is in the operational position, the curtain having at least one side and a bottom, a top of the side adapted for coupling to the curtain support portion, the bottom having a drain port;

wherein the curtain support portion comprises one of a "U" shape, a "V" shape and a semicircular shape to cause the suspended curtain to define a working volume adapted to receive the elevated fixture, and an opening formed on one side of the curtain to allow access to the working volume.

2. The apparatus of claim 1, wherein the drain port is adapted to connect to a hose.

3. The apparatus of claim 1, wherein the base portion comprises a first frame portion slidably engaged with a second frame portion to provide thereby lateral position adjustment of the vertical member.

4. The apparatus of claim 1, wherein the vertical member comprises a plurality of vertical member portions, the vertical member portions cooperating to selectively define an overall length of the vertical member.

5. The apparatus of claim 4, further comprising a wire and pully mechanism arranged to control the overall length of the vertical member.

6. The apparatus of claim 4 further comprising a linear actuator mechanism arranged to control the overall length of the vertical member, the linear actuator mechanism comprising one of an electric motor actuator, a set screw, a hydraulic actuator and a pneumatic actuator.

7. The apparatus of claim 1, wherein the base portion comprises:

a support portion coupled to the vertical member; and at least one lateral extension portion extensibly engaged with the base portion to operate in either of a retracted mode and an extended mode.

8. The apparatus of claim 1, wherein the base portion comprises:

a support portion coupled to the vertical member; and proximal and distal lateral extension portions extensibly engaged with the base portion to operate in either of a retracted mode and an extended mode.

9. The apparatus of claim 8, wherein the base portion further comprises:

at least one secondary extension portion extensibly engaged with a corresponding lateral extension portion.

10. The apparatus of claim 1, wherein the vertical member and base portion are pivotally coupled, the portable assembly being further configurable between an erect position and a retracted position.

11. The apparatus of claim 10, further comprising:

a locking mechanism to secure the vertical member to the base in the retracted position.

12. The apparatus of claim 10, wherein:

the base portion is coupled to a first set of wheels positioned to enable stable motion of the portable assembly in either of the collapsed position and the operational position; and the base portion is coupled to a second set of wheels positioned to enable stable motion of the portable assembly in the retracted position.

13. The apparatus of claim 1, wherein the base portion is coupled to a first set of wheels positioned to enable stable motion of the portable assembly in either of the collapsed position and the operational position.

14. The apparatus of claim 1, wherein the curtain support member and vertical member are rotatably coupled.

15. The apparatus of claim 14, wherein the base portion comprises a first frame portion slidably engaged with a second frame portion to provide thereby lateral position adjustment of the vertical member.

16. The apparatus of claim 15, wherein the vertical member comprises a plurality of vertical member portions, the vertical member portions cooperating to selectively define an overall length of the vertical member.

17. A chandelier cleaning system, comprising:

a portable assembly comprising:

a base portion;

a vertical member coupled to the base portion; and a curtain support portion coupled to the vertical member, an elevation of the curtain support portion relative to the base portion being adjustable via the vertical member;

the portable assembly being configurable between a collapsed position and an operational position, the collapsed position having a size adapted to fit through a standard door opening; and a curtain sized to be suspended from the curtain support portion when the curtain support portion is in the operational position, the curtain having at least one side and a bottom, a top of the side adapted for coupling to the curtain support portion, the bottom having a drain port;

wherein the curtain support portion comprises one of a "U" shape, a "V" shape and a semicircular shape to cause the suspended curtain to define a working volume adapted to receive the elevated fixture, and an opening formed on one side of the curtain to allow access to the working volume.

* * * * *